US006453499B1

(12) United States Patent
Leuermann

(10) Patent No.: US 6,453,499 B1
(45) Date of Patent: Sep. 24, 2002

(54) TOOTHBRUSH

(76) Inventor: Walter B. A. Leuermann, 16 Cunningham St., Rochedale (AU), 4123

( * ) Notice: Subject to any disclaimer, the term of this patent is extended or adjusted under 35 U.S.C. 154(b) by 0 days.

(21) Appl. No.: 09/719,115

(22) PCT Filed: Jun. 15, 1999

(86) PCT No.: PCT/AU99/00478

§ 371 (c)(1),
(2), (4) Date: Feb. 21, 2001

(87) PCT Pub. No.: WO99/65359

PCT Pub. Date: Dec. 23, 1999

(30) Foreign Application Priority Data

Jun. 12, 1998 (AU) ..... PP 4090

(51) Int. Cl.[7] ..... A46B 9/04; A46B 7/06

(52) U.S. Cl. ..... 15/28; 15/22.1

(58) Field of Search ..... 15/22.1, 8

(56) References Cited

U.S. PATENT DOCUMENTS

| | | | | |
|---|---|---|---|---|
| 1,557,244 A | * | 10/1925 | Domingue | 15/28 |
| 4,827,550 A | | 5/1989 | Graham et al. | 15/22.1 |
| 5,068,939 A | | 12/1991 | Holland | 15/22.1 |
| 5,120,225 A | | 6/1992 | Amit | 433/216 |
| 5,186,627 A | | 2/1993 | Amit et al. | 433/216 |
| 5,274,870 A | | 1/1994 | Stollman | 15/22.1 |
| 5,276,932 A | | 1/1994 | Byrd | 15/28 |
| 5,715,556 A | | 2/1998 | Chung | 15/22.1 |

FOREIGN PATENT DOCUMENTS

| | | | | |
|---|---|---|---|---|
| DE | 1805982 | * | 6/1969 | 15/22.1 |

* cited by examiner

*Primary Examiner*—Mark Spisich
(74) *Attorney, Agent, or Firm*—Quarles & Brady LLP

(57) ABSTRACT

A toothbrush having a handle that can move relative to a head portion equipped with rotatable bristle assemblies. The rotation of the bristles of the bristle assemblies is effected by a manual operable drive member consisting of a rack and a plurality of mating pinions from which the bristle extend. The rack and the pinions are enclosed within a housing.

4 Claims, 3 Drawing Sheets

TOOTHBRUSH

This invention relates to a toothbrush.

Dentists and other dental professionals have long recognized the advantages in applying a rotary motion to the bristles of a toothbrush when cleaning teeth such that the bristles move in a generally circular path across the surface of the teeth. This is particularly important in the region where the teeth protrude from the gum line.

It has been observed that the desired rotational action of the bristles can be difficult to achieve using conventional toothbrushes of the type having a head portion that is rigidly connected to a handle due to the size and configuration of both the toothbrush and the person's mouth.

Attempts have been made to overcome the aforementioned problems by providing toothbrushes that have a head portion which is flexibly connected to the handle. However this still does not overcome the problem that rotational motion of the bristles can only be achieved by the user rotating the entire head portion inside the user's mouth. This can be rather difficult and wherein generally speaking only the surfaces of some teeth can be cleaned in this manner, particularly if contact with the adjacent surfaces of the mouth are to be avoided.

Toothbrushes having electrically driven rotatable bristles are known. However, electric toothbrushes tend to be rather expensive to purchase. Furthermore, it has been observed that many people are generally hesitant about placing an electrically powered device in their mouths in the belief that it is potentially dangerous to do so. Manually operated toothbrushes thus remain by far the preferred means by which persons clean their teeth.

Prior attempts have been made to provide a manually operated toothbrush that can impart a rotary motion to its brush head and thus the bristles mounted thereon. However, a disadvantage associated with many of these devices is that two hands are often required to operate them. It has also been observed that the construction of many of these devices does not enable users to easily clean the rear molars. In particular, the size of the mouth and the construction of many of the devices prohibits lateral movement of the rotatable bristles across the crown of the rear molars. Furthermore, in many instances the bristles do not move in a circular motion over the surface of the teeth.

It is an object of the present invention to provide a toothbrush that overcomes at least one of the aforementioned disadvantages and which will be reliable and efficient in use.

With the foregoing and other objects in view this invention in one aspect resides in a manually operable toothbrush including:

a handle having drive means associated with one end thereof;

a housing that in use is locatable inside a user's mouth and which is adapted to receive said drive means;

a tube connected to-said housing and through which said handle extends;

a bristle assembly that is capable of rotation relative to said housing, said bristle assembly having a driven portion that is retained within said housing and which is operatively connected to said drive means and wherein rotation of said bristle assembly is effected by reciprocal movement of said handle relative to said housing, and whereby in use a free end of said tube is always located outside the user's mouth.

The housing may, in some embodiments, be capable of flexible movement relative to said handle. For example, the connection connecting the handle to the housing may be a flexible connection. Alternatively, the handle, or selected portions of the handle, may be constructed from a flexible material.

In addition to having a plurality of rotatable bristles, the housing may also include a plurality of bristles whose position relative to said housing are fixed. The bristles may be arranged according to a particular pattern. For example, the rotatable bristles may be surrounded by fixed bristles that extend along the periphery of the head portion. In addition, the length of the fixed bristles and the rotatable bristles may be the same or may differ. For example, in one embodiment the longer rotatable bristles may stand proud of the fixed bristles.

The drive means may consist of a rack and at least one mating pinion and wherein the rotatable bristles may be mounted on said pinion. In one embodiment, the rack may be connected to or formed integrally with the handle and wherein rotational movement of the bristles is effected by reciprocal movement of the handle towards and away from the housing. Alternatively the rack may consist of a driving member that is slidably mounted on the handle and wherein movement of the driving member may be effected using the user's thumb.

The rack may also include motion dampening means, such as a tension or compression spring connected to and located intermediate one end of the rack and an opposing end of a separate driving member used to impart motion to the rack. The motion dampening means may be used to compound the extent of rotational movement of the bristles derived from movement of the driving member.

The drive means, or a significant portion of same, is preferably enclosed within the housing of the toothbrush thereby reducing the likelihood of saliva and food products becoming trapped within the drive means. For example, the rack like end portion of the handle and the mating pinions may be housed within a tubular housing. The housing preferably includes a closed end which is inserted in the user's mouth and an opening at the other end through which the handle extends, and wherein the opening is never placed inside the user's mouth during use.

The toothbrush may also include locking means that may be used to selectively prevent rotational movement of the bristles if desired. This may be particularly beneficial where movement of the bristles is effected by movement of the handle as it will also allow the user to use the toothbrush in a conventional manner.

In another aspect this invention resides in a toothbrush including:

a handle;

a head portion connected to said handle, said head portion having a plurality of bristles that are capable of rotation relative to said head portion about an axis that extends laterally from said handle;

drive means associated with said handle for manually driving said rotatable bristles, and locking means that may be used to selectively disable said drive means.

For example the locking means may simply include a pin that is locatable within aligned apertures formed in the driving member and an adjacent portion of the head portion. When the pin is partially withdrawn such that it no longer engages one of the apertures, the driving member is free to move relative to the head portion. When the pin is removed entirely the driving member can be separated from the rest of the unit thereby enabling a thorough cleaning of the unit if so desired and, if necessary, the replacement of the head portion should the bristles be worn and/or splayed apart.

In another aspect this invention resides in a toothbrush including:

a handle;

a head portion connected to said handle, said head portion having a plurality of bristles that are capable of rotation relative to said head portion about an axis that extends laterally from said handle, and drive means associated with said handle for manually driving said rotatable bristles, and wherein the portion of said drive means that in use is located inside a person's mouth is housed within said head portion.

Preferably the arrangement of the drive means and the head portion is such that during use, little if any saliva and food products can become trapped inside the head portion amongst the drive means.

For example, the drive means may consist of a rack and at least one mating pinion and wherein the rotatable bristles may be mounted on said pinion. In one embodiment, the rack may be connected to or formed integrally with the handle and wherein rotational movement of the bristles is effected by reciprocal movement of the handle towards and away from the head portion. Alternatively the rack may consist of a driving member that is slidably mounted on the handle and wherein movement of the driving member may be effected using the user's thumb.

The rack may also include motion dampening means, such as a tension or compression spring connected to and located intermediate one end of the rack and an opposing end of a separate driving member used to impart motion to the rack. The motion dampening means may be used to compound the extent of rotational movement of the bristles derived from movement of the driving member.

The rack like end portion of the handle and the mating pinions may be housed within a tubular housing that forms part of the head portion. The housing preferably includes a closed end which is inserted in the user's mouth and an opening at the other end through which the handle extends, and wherein the opening is never placed inside the user's mouth during use.

In order that this invention may be more easily understood and put into practical effect, reference will now be made to the accompanying drawings which illustrate a preferred embodiment of the invention, wherein.

Figure 1:
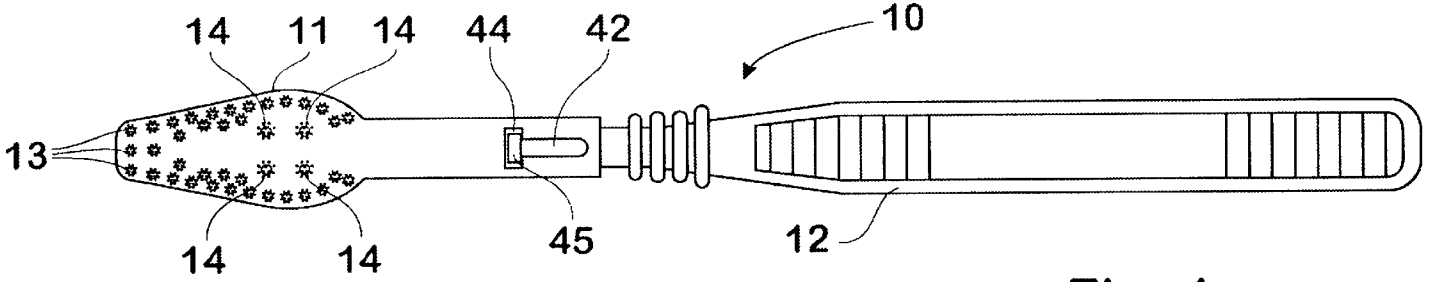
FIG. 1 is a plan view of a toothbrush constructed in accordance with the present invention.

FIGS. 1 to 4 show a toothbrush 10 that includes a head portion 11 that is connected to a handle 12 and wherein the head portion 11 includes a plurality of fixed bristles 13 and four sets of rotatable bristle assemblies 14.

Figure 6:
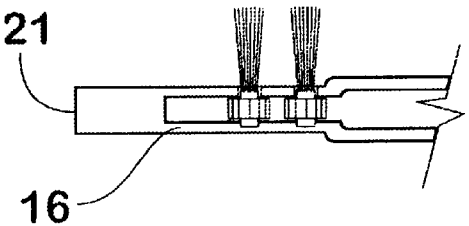
FIG. 6 is a side cross-sectional view of a pair of mountings belonging to the toothbrush illustrated in FIG. 1.
Figure 5:
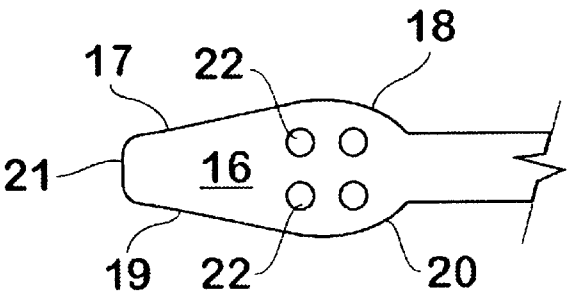
FIG.5 is a plan view of four mountings belonging to the toothbrush illustrated in FIG. 1.
Figure 8:
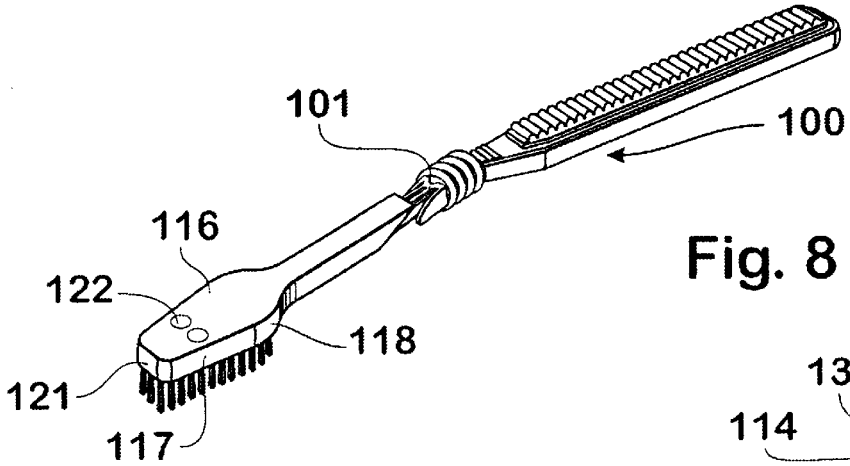
FIG. 8 is a pictorial view of an alternative toothbrush constructed in accordance with the present invention.

The head portion 11 includes a substantially diamond shaped receptacle 15 having a base wall 16 and opposing side walls 17, 18, 19, 20 and 21. The receptacle further includes four axles 22 that extend upwardly from the base wall 16 as illustrated in FIGS. 5 and 6. The receptacle 15 is closed by a lid 23 that includes a plurality of apertures 24 formed therein through which bristles 13 and individual bristle assemblies 14 extend.

Figure 2:
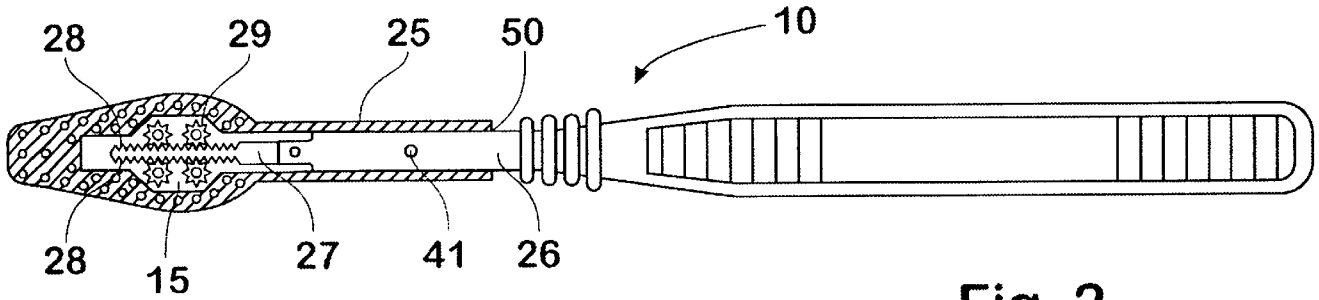
FIG. 2 is a partial cross-sectional plan view of the toothbrush illustrated in FIG. 1.
Figure 3:
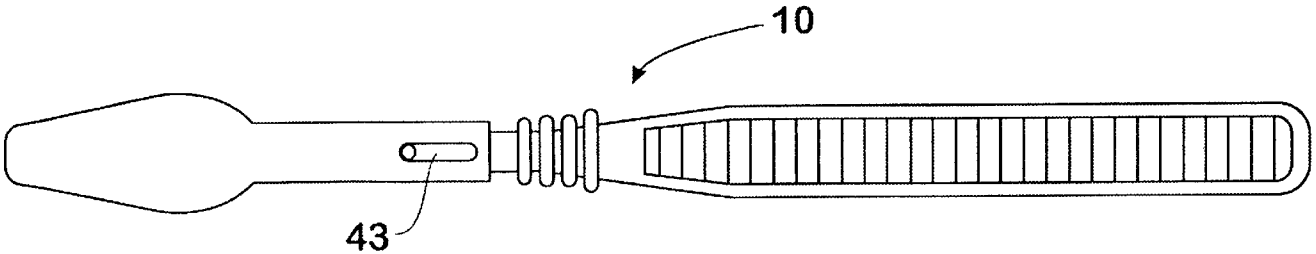
FIG. 3 is a view of the underside of the toothbrush illustrated in FIG. 1.
Figure 4:
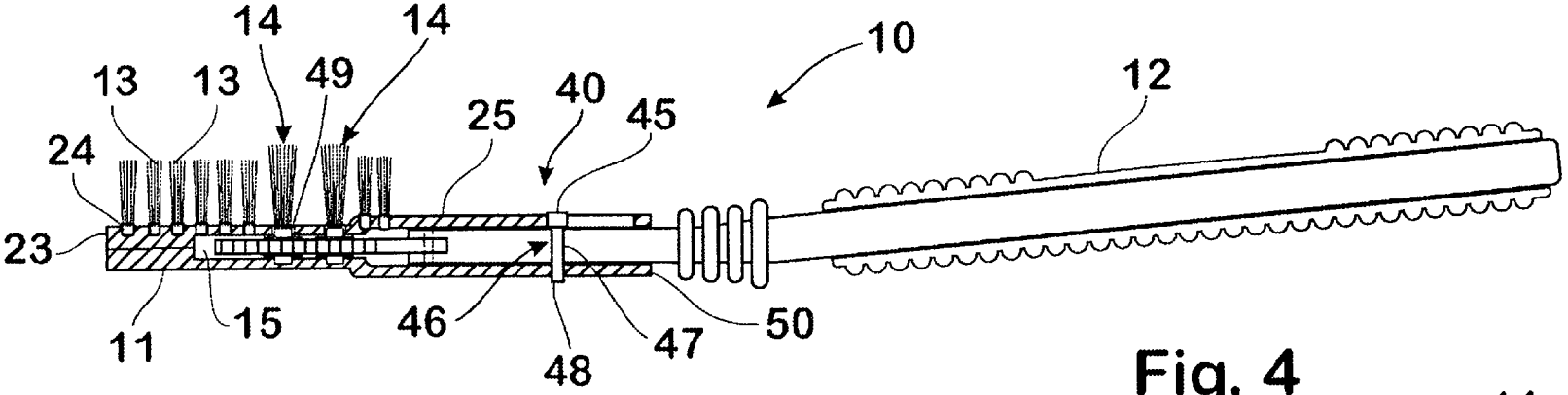
FIG. 4 is a partial cross-sectional side view of the toothbrush illustrated in FIG. 1.
Figure 7:
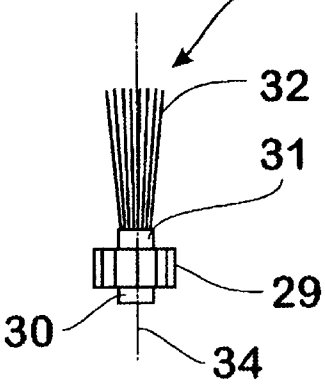
FIG. 7 is a side view of a pinion belonging to the toothbrush illustrated in FIG. 1.

The receptacle 15 is attached to a tubular housing 25 that communicates with the receptacle 15 as illustrated in FIGS. 2 and 4.

The handle 12 includes an intermediate portion 26 and a rack like end portion 27 having two opposing rows of teeth 28. The intermediate portion 26 is slidably received within the tubular housing 25 as shown in FIGS. 2 and 4.

The bristle assemblies 14 each include a cog 29 located intermediate a shoulder 30 and a tubular housing 31 which is adapted to receive and retain the ends of a plurality of bristles 32 that extend upwardly therefrom. The shoulder includes an axially located, cylindrically shaped, bore which is adapted to receive a respective axle 22.

The toothbrush 10 is constructed in a manner whereby individual bristle assemblies 14 are each rotatably mounted on a respective axle 22. The rack like end portion 27 is then placed within the receptacle 15 such that the teeth 28 mesh with the teeth of adjacent cogs 29. The bristle assemblies 14 are then retained in position by the placement of the lid on top of the receptacle 15 such that it effectively closes same.

The toothbrush also includes locking means 40 that may be selectively used to prevent longitudinal movement of the handle 12 relative to the head portion 11. The locking means 40 includes an aperture 41 formed in the intermediate portion 26 of the handle 12 and two opposing slots 42 and 43 formed in the tubular housing 25. The slots 42 and 43 are aligned with one another and the aperture 41 as shown in FIGS. 1 to 4.

The slot 42 includes an enlarged head portion 44 that is adapted to receive the head portion 45 of a pin 46 that includes a shaft 47 that extends through the aligned slots as illustrated in FIG. 4.

In use, reciprocal longitudinal movement of the handle 12 relative to the head portion 11 shall cause the bristle assemblies 14 to rotate about respective axes 34. This is only permitted when the head portion 45 of the pin 46 is not located in the head portion 44 of slot 42. This may be easily achieved by pressing against the end 48 of pin 46 such that it lies substantially flush with the surrounding wall of the housing 25, the shaft 47 being free to travel along the length of the aligned apertures 42 and 43.

The rotational movement of the bristles 32 it is believed will assist with the cleaning of the user's teeth. However, if the user wishes to use the toothbrush in a more conventional manner, he or she may push the head portion 45 down such that it is retained in the slotted head portion 44, as illustrated in FIG. 4. When the pin 46 is in this position the handle 12 can not move relative to the head portion 11. Consequently the bristles 34 do not rotate and wherein the toothbrush 10 functions like most manual toothbrushes that have several rows of fixed bristles.

The user may separate the handle 12 and the head portion 11 by removing the pin 46. This enable the head portion 11 to be cleaned such as by immersing the head portion in a glass containing a suitable disinfectant. Furthermore, if the bristles 13 and 32 are worn or splayed apart, the head portion 11 may be replaced by a new head portion while retaining the handle 12.

The construction of the head portion is such that little, if any, saliva or food products will pass through the apertures 24 formed in the lid 23 through which the bristles extend. Similarly, because the fit between the apertures 49 in the lid 23 through which the respective tubes 32 extend is a close fit, again it is believed that little, if any, saliva or food products will pass therethrough.

Furthermore the opening 50 in the housing 25 and the slots 42 and 43 are located far enough away from the head portion 11 that in use neither the slots 42 and 43 or the opening 50 Will be placed in the user's mouth. Consequently, there is little likelihood that saliva and food products will enter the housing 15 containing the rack and pinion members vie the slots 42 and 43 or the opening 50, In the light of the above it is therefore believed that the toothbrush 10 will be easier to use than the prior art; will enable user's to clean their teeth better than conventional toothbrushes because of the inclusion of the rotating bristles 32 will be more hygienic and wherein worn parts can be easily replaced with new parts.

FIGS. 8 to 11 show another toothbrush 100 that includes a head portion 111 that is connected to a handle 112 and wherein the head portion 111 includes a plurality of fixed bristles 113 and two sets of rotatable bristle assemblies 1 14.

The head portion 111 includes a substantially diamond shaped receptacle 115 having a base wall 116 and opposing side walls 117, 118, 119 120,and 121. The base wall 116 includes two aperture 122 formed therein. The receptacle 115 is closed by a lid 123 that includes a plurality of apertures 124 formed therein through which bristles 113 and individual bristle assemblies 114 extend.

Figure 9:
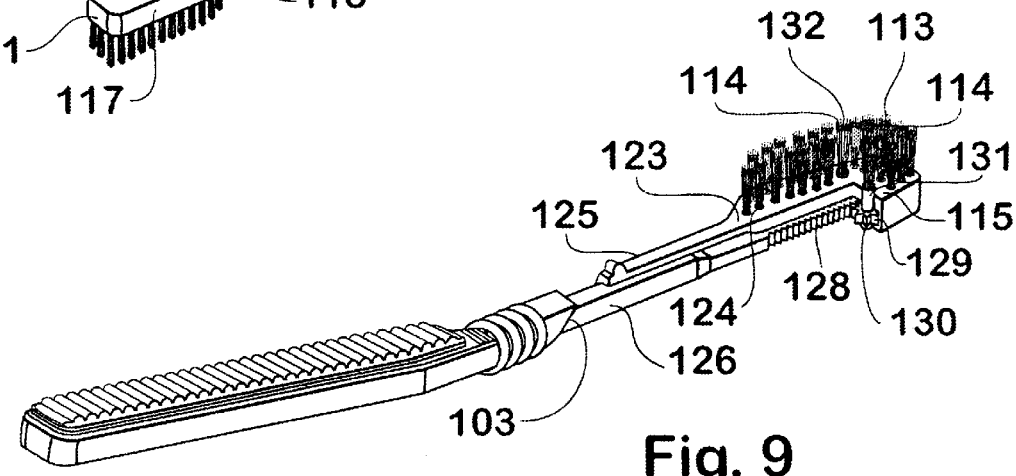
FIG. 9 is a pictorial view of the toothbrush illustrated in FIG. 9 but wherein a portion of the housing has been removed.
Figure 11:
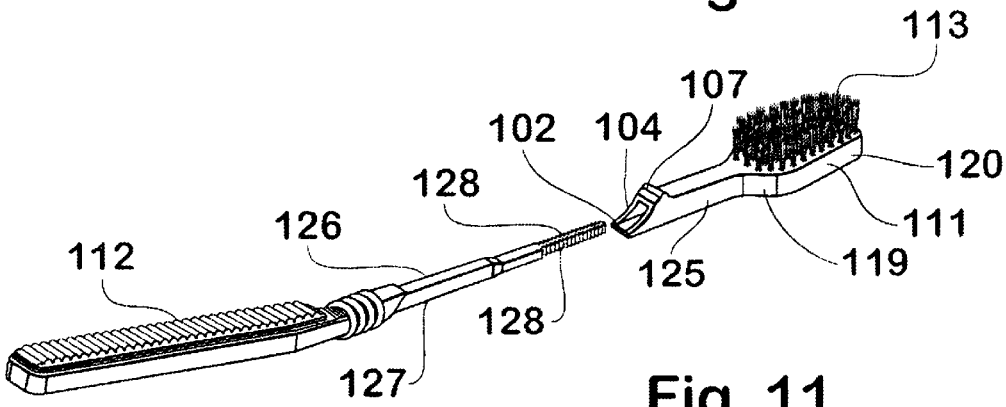
FIG. 11 shows the toothbrush illustrated in FIG. 8 apart and in line for assembly.
Figure 10:
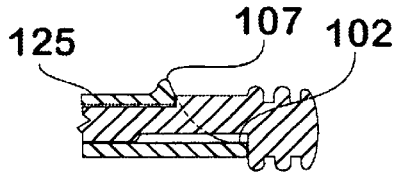
FIG. 10 is a cross-sectional view of the handle of the toothbrush illustrated in FIG. 8.

The receptacle 115 is attached to a tubular housing 125 that communicates with the receptacle 115 as illustrated in FIGS. 9 and 11. The housing 125 has a generally rectangular shaped transverse cross-section.

The handle 112 includes an intermediate portion 126 and a rack like end portion 127 having two opposing rows of teeth 128. The intermediate portion 126 has a generally rectangular shaped transverse cross-section and is slidably received within the tubular housing 125 as shown in FIG. 9. The intermediate portion 126 includes a depending flange 101 that in use is locatable behind an inwardly pointing nib 102 that extends from the opening to the housing 125. Engagement of the nib 102 with the flange 101 prevents any unintentional withdrawal of the handle 112 out of the head portion 111 during use while maintaining engagement of the teeth 128 with the rotating bristle assemblies 114. The location of the flange 101 on the handle 112 marks the rearward extremity of the reciprocating motion of the handle relative to the head portion 111.

The intermediate portion also includes a curved shoulder 103 that in use selectively abuts against the curved mouth 104 of the housing 125. Abutment of the shoulder 103 with the mouth 104 marks the forward extremity of the reciprocating motion of the handle 112 relative to the head portion 111.

The bristle assemblies 114 each include a cog 129 located intermediate a stub axle 130 and a tubular housing 131. Each stub axle 130 is locatable within a respective aperture 122 and is capable of rotating relative thereto. The housing 131 is adapted to receive and retain one end of a bristles 132 that extends upwardly therefrom.

The toothbrush 100 is constructed in a manner whereby individual bristle assemblies 114 are each rotatably mounted on a respective axle 129. The rack like end portion 127 is then placed within the receptacle 115 such that the teeth 128 mesh with the teeth of adjacent cogs 129.

In use, reciprocal longitudinal movement of the handle 112 relative to the head portion 111 shall cause the bristle assemblies 114 to rotate about respective longitudinal axes. The rotational movement of the bristles 132 is believed will assist with the cleaning of the user's teeth.

However, if the user wishes to use the toothbrush in a more conventional manner, he or she may push their cheek against the head portion 111 so as to immobilise. Then using the thumb, of the hand that is holding the handle 112, to engage the finger abutment 107, of the housing 125, they may prevent continued reciprocal movement of the handle 112 relative to the head portion 111 while they brush their teeth.

It will of course be realised that the above has been given only by way of illustrative example of the present invention and that all such modifications and variations thereto as would be apparent to persons skilled in the art are deemed to fall within the broad scope and ambit of this invention as is herein before defined in the appended claims.

The claims defining the invention are as follows:

1. A manually operable toothbrush including:

a handle for gripping the toothbrush, said handle having drive means associated with one end thereof;

a housing that in use is locatable inside a user's mouth and which is adapted to receive said drive means, said housing having a tube connected thereto and through which a portion of said handle extends, which portion includes the one end thereof; and at least one bristle assembly that is capable of rotation relative to said housing, said at least one bristle assembly having a driven portion that is retained within said housing and which is operatively connected to said drive means and wherein rotation of said at least one bristle assembly is effected by reciprocal movement of said handle relative to said housing, and whereby in use a free end of said tube is retained outside the user's mouth.

2. A toothbrush as claimed in claim 1, wherein said drive means includes a rack and said driven portion of said bristle assembly includes a pinion which is adapted to mate with said rack.

3. A toothbrush as claimed in claim 1, wherein there is also provided locking means for selectively preventing reciprocal movement of said handle relative to said housing.

4. A toothbrush as claimed in claim 1, wherein the housing further includes at least one fixed bristle assembly attached thereto.

* * * * *